United States Patent [19]

Lundberg

[11] Patent Number: 4,737,655

[45] Date of Patent: Apr. 12, 1988

[54] PRIME MOVER CONTROL

[75] Inventor: Richard E. Lundberg, Ashby, Mass.

[73] Assignee: General Electric Company, Schenectady, N.Y.

[21] Appl. No.: 878,737

[22] Filed: Jun. 26, 1986

[51] Int. Cl.[4] ..... F01B 25/00

[52] U.S. Cl. ..... 290/51; 290/40 R

[58] Field of Search ..... 290/40 R, 40 A, 51; 318/591

[56] References Cited

U.S. PATENT DOCUMENTS

| | | | |
|---|---|---|---|
| 4,071,897 | 1/1978 | Groves, Jr. et al. | 290/40 A X |
| 4,204,258 | 5/1980 | Zitelli et al. | 290/40 A X |
| 4,464,577 | 8/1984 | Wagner et al. | 290/40 A |
| 4,469,994 | 9/1984 | Lundberg et al. | 318/591 |
| 4,514,642 | 4/1985 | Ross | 290/40 A X |

*Primary Examiner*—William M. Shoop, Jr.
*Assistant Examiner*—W. E. Duncanson, Jr.
*Attorney, Agent, or Firm*—Jerome C. Squillaro

[57] ABSTRACT

In a prime mover, an improved control system is provided for accelerating and decelerating the prime mover through periods of critical operation.

5 Claims, 2 Drawing Sheets

PRIME MOVER CONTROL

BACKGROUND OF THE INVENTION

This invention relates to the control of fluid driven prime movers such as a steam turbine and, in particular, relates to a manual input for accelerating the control valve position during certain periods of turbine operation.

The control of large rotating equipment such as fluid driven prime movers is accomplished by controlling the fluid input into the machine. Large control valves are positioned in accordance with a valve position signal which may be automatically or manually input. The valve position signal may be the result of the electronic combination of a desired speed signal with a speed feedback signal. In the inventor's experience, the means for setting a desired speed signal may have a slow or fast counter set but the rate set for valve position is nevertheless constant. However, there are so-called critical conditions of resonance or turbulence when it would be desirable to accelerate the turbine through certain speed ranges to minimize the transition time through the so-called critical condition.

OBJECTS AND SUMMARY OF THE INVENTION

It is an object of the present invention to improve the state of the art in turbine control systems by providing a means to accelerate the turbine through certain operating phases.

It is an object of the invention to provide a means for manually inputting an acceleration signal to a turbine control system whereby valve actuation and therefore turbine operation is accelerated as desired.

It is an object of the invention to provide a turbine control system wherein valve position may be accelerated in either the valve open or valve closed direction.

Other objects and advantages will become apparent from the following detailed description of the invention and the novel features will be particularly pointed out hereinafter in the claims.

In a fluid driven prime mover, the speed of the prime mover is dependent on the amount of fluid inflow into the turbine. Fluid flow is determined by the position of the control valves. During normal operation, a valve position signal is input into a turbine and the valves move at a rate which is constant no matter what the final valve position. The present invention produces a variable rate valve position signal dependent upon the position of a linear variable differential transformer (LVDT) thereby enabling the turbine operator to more rapidly change valve position under certain conditions.

DETAILED DESCRIPTION OF THE INVENTION

Figure 1:
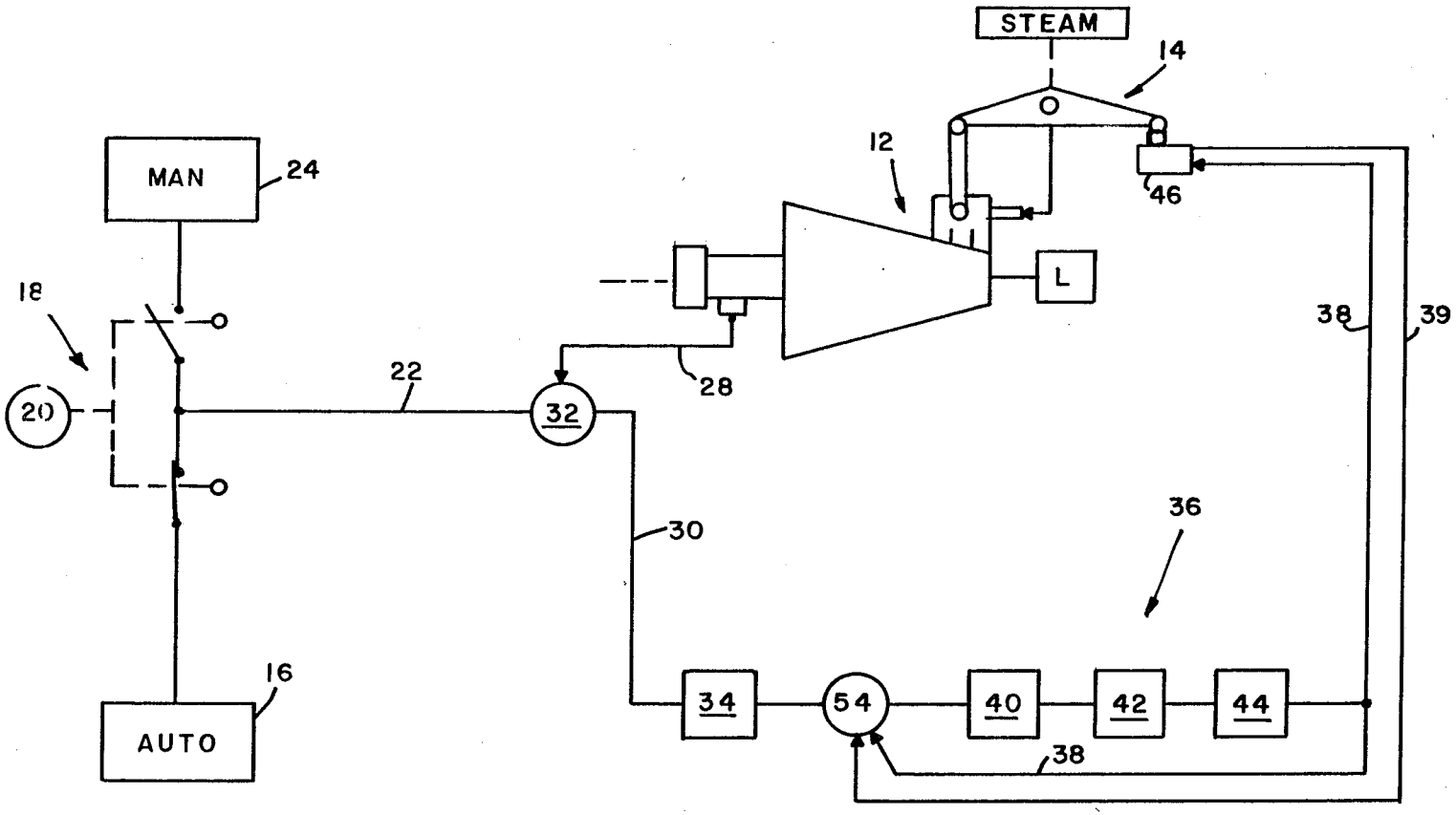
FIG. 1 is a schematic drawing of a turbine control system.

Referring now to FIG. 1, a prime mover such as a steam turbine 12 includes a bladed rotor (not shown) which is rotated by a flow of motive fluid (steam). Steam input to the turbine is controlled by valve gear 14 in a manner well known by turbine manufacturers and operators.

A valve position signal is developed in the following manner. Assuming an automatic input 16 from a plant computer or otherwise, the input may be the equivalent of the desired turbine rotational speed which passes through switching circuit 18 controlled by relay 20 which allows either the automatic signal input or a manual signal input device 24 to be passed into a valve position circuit 36. The desired or target speed signal 22 is summed with a feedback speed signal 28 to provide a speed error signal 30. The speed error signal is output from summing junction 32 and subjected to an electronic stop 34 which limits the magnitude of the applied signal to the valve positioning circuit 36.

The valve positioning circuit 36 includes an amplifier 40, servo valve 42 and a hydraulic amplifier 44 all connected in series to the valve gear 14 at valve actuator 46. The valve position signal 38 and a valve position feedback signal 39 are input into electronic summer 54 in a manner well known in the art.

Reference is now made to U.S. Pat. No. 4,469,994 to Lundberg and Murphy issued Sept. 4, 1984 and incorporated herein by said reference. In that patent, certain functions are depicted in detail which have been eliminated in the present detailed description of the invention for simplicity but which need brief explanation. A so-called signal memory function (SMF) 16 provides a means for tracking and storing the last automatic signal until such time that it is updated by a manual input. Manual signal inputs are controlled by a pair of pushbuttons at dual but fixed rates determined by an oscillator (OSC) connected to the outputs of the slow or fast pushbuttons.

Figure 2:
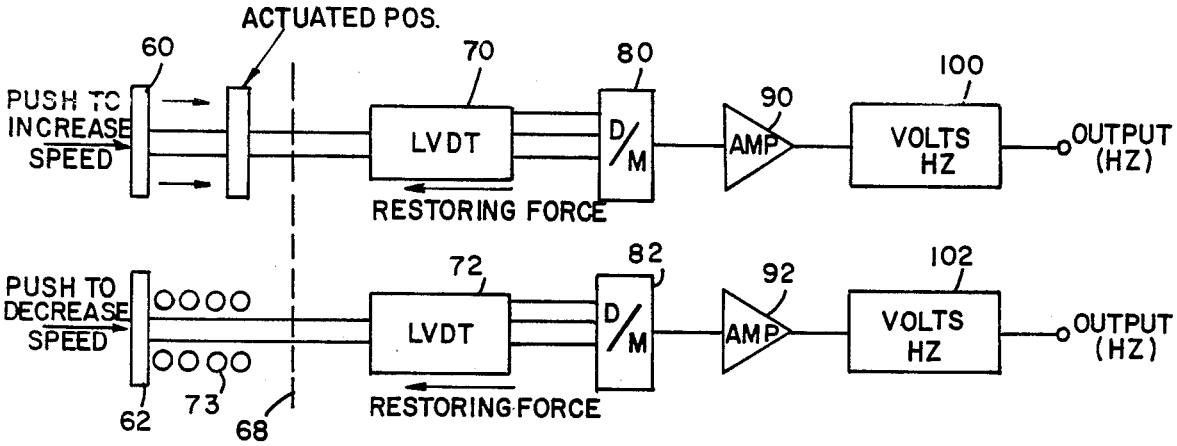
FIG. 2 is a detailed drawing of a preferred embodiment of the present invention.
Figure 3:
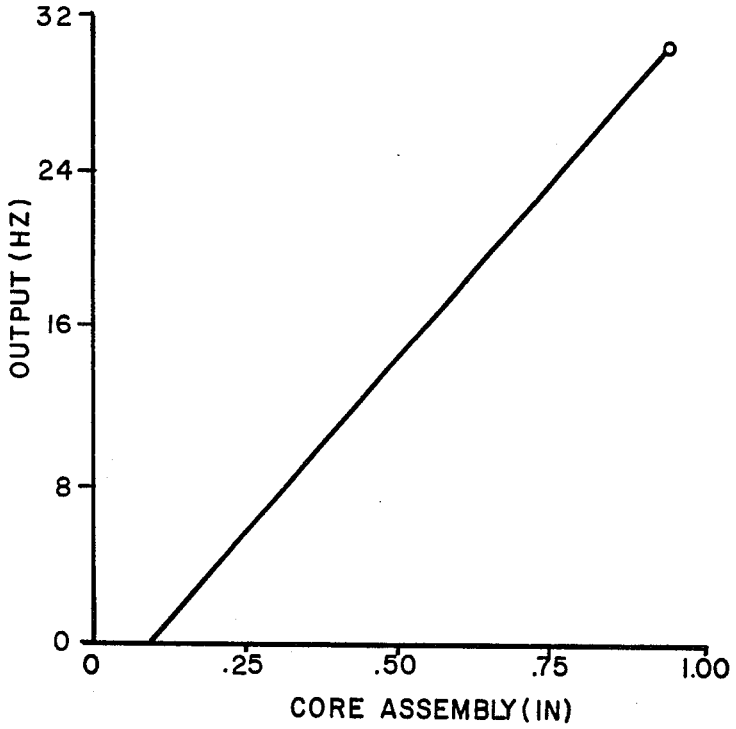
FIG. 3 is an input/output curve in accordance with the present invention.

Referring to FIG. 2 in the present application, a pair of speed change pushbuttons includes an increase pushbutton 60 and a decrease pushbutton 62 mounted to a control panel 68. Each pushbutton is connected to a respective variable output signal generator such as linear variable differential transformer 70 and 72 (LVDT). The pushbuttons are restored to their original position by a restoring force attributable to spring 73 for each pushbutton but only one shown. The function of the LVDT is shown in FIG. 3 whereupon it is noted that the input stroke in inches provides a resultant frequency output (HZ) which is variable with the input. The LVDT could be a suitable model produced by Kavlico of Chatsworth, Calif. The output of each LVDT is input into a respective increase (80) or decrease (82) demodulator (Kavlico Model GM 6244) which converts the LVDT output into a voltage. Increase amplifier 90 or decrease amplifier 92 (741 or equivalent) scales and buffers the respective outputs for input into respective voltage controlled oscillators 100 (increase) and 102 (decrease) manufactured by Teledyne Philbrick (Model No. 7402 or equivalent) which then supplies the frequency output shown in FIG. 3 in accordance with the LVDT input in inches. As such, the invention could then be incorporated into a turbine control in accordance with the teachings of the reference U.S. Pat. No. 4,469,994.

OPERATION

The operation of the present invention described is as follows. As a turbine is operated, certain critical speeds will occur which may have to do with blade natural frequencies or other turbine phenomena. It is desirable to be able to move away from these frequencies as quickly as possible so as not to incur potential damage due to physical vibrations. In accordance with prior art practice, valve position was usually set at a predetermined rate in accordance with anticipated system needs. Moreover as shown in U.S. Pat. No. 4,469,994 the rate at which a valve position signal could be applied to a turbine may be varied from a slow fixed rate to a fast fixed rate. However, the present invention provides a set of pushbuttons to increase turbine speed or decrease turbine speed through rapid valve movement in accordance with the position of the respective LVDT's. Thus in operation as a critical speed is approached, the operator depresses the appropriate button to provide a valve position signal applied at an accelerated rate which causes the turbine to rapidly depart from the critical speed. As the operator's finger is removed from the pushbutton, the valves remain in their last position and the LVDT is restored to its original or unactuated position.

While there is shown what is considered to be a preferred embodiment of the invention, it is recognized that other modifications may be made therein, and it is intended to cover all such modifications as fall within the true spirit and scope of the invention. For example, although the invention is embodied in speed change pushbuttons, such pushbuttons are the functional equivalent of valve position change pushbuttons or any other functional equivalent. It is also true that while the manual input is shown in terms of a linear variable displacement transformer (LVDT), the input device could also be an equivalent rotary device as available.

What is claimed is:

1. A control system for a prime mover including an improved manual signal device for inputting a desired setpoint signal for controlling the speed of the prime mover wherein the improved manual signal device comprises a linear variable differential transformer for providing an output signal having a variable rate in accordance with an input manual displacement signal.

2. A control system for a prime mover including an improved manual signal device for inputting a desired setpoint signal for controlling the speed of the prime mover wherein the improved manual signal device comprises a pushbutton connected to a linear variable differential transformer.

3. The control system recited in claim 2 further comprising means for converting the output voltage of said linear variable differential transformer into a variable output frequency.

4. A prime mover control system including a manual input device for providing a variable rate speed change signal to the prime mover control under certain transitory prime mover operating conditions said manual input device comprising:

A spring loaded, linearly displaceable pushbutton;

A linear variable differential transformer (LVDT) connected to said pushbutton providing an output frequency signal proportioned to the displacement of the pushbutton;

demodulator/modulator means connected to the LVDT output for converting the LVDT output to a voltage:

signal conditioning means for amplifying said demodulator/modulator output; and, a voltage to frequency converter for converting the voltage output to a variable rate frequency.

5. The control system recited in claim 4 wherein there are two identical manual input devices for incrementing and decrementing the speed change signal respectively.

* * * * *